US005380132A

United States Patent [19]

Parks

[11] Patent Number: 5,380,132

[45] Date of Patent: Jan. 10, 1995

[54] DEPTH ADJUSTING SYSTEM FOR A POWER TOOL

[75] Inventor: James R. Parks, Timonium, Md.

[73] Assignee: Black & Decker Inc., Newark, Del.

[21] Appl. No.: 119,767

[22] Filed: Sep. 10, 1993

[51] Int. Cl.[6] ..... B25B 21/00

[52] U.S. Cl. ..... 408/113; 81/429; 408/202; 408/241 S

[58] Field of Search ..... 81/429; 408/14, 113, 408/116, 202, 241 S; 409/184, 214, 218, 221; 74/89.15, 424.8 R

[56] References Cited

U.S. PATENT DOCUMENTS

| | | | |
|---|---|---|---|
| 2,940,488 | 6/1960 | Riley, Jr. | 81/429 |
| 3,527,273 | 9/1970 | Falter | 81/429 |
| 4,630,512 | 12/1986 | Dürr | 81/429 X |
| 4,647,260 | 3/1987 | O'Hara et al. | 408/241 S |

FOREIGN PATENT DOCUMENTS

| | | |
|---|---|---|
| 1981300 | 10/1967 | Germany . |
| 2220792 | 2/1981 | Germany . |
| 2220790 | 6/1981 | Germany . |
| 3431630 | 3/1986 | Germany . |
| 3308135 | 10/1987 | Germany . |
| 3831960 | 8/1990 | Germany . |
| 3242862 | 3/1992 | Germany . |
| 3818924 | 3/1992 | Germany . |
| WO92/15428 | 9/1992 | WIPO . |

*Primary Examiner*—Steven C. Bishop
*Attorney, Agent, or Firm*—Harness, Dickey & Pierce

[57] ABSTRACT

A depth adjusting system particularly for power-driven screwdrivers comprising an adjustment collar that is releasably fitted to the housing of the tool and a depth locator which screws onto the collar. The adjustment collar has a forward cylindrical portion and an enlarged rearward cylindrical portion that includes a pair of diametrically opposed, axially extending cantilevered spring fingers for detachably connecting the adjustment collar to a circular opening in the housing. The free ends of the spring fingers are provided with a hook and groove that are adapted to engage and mate with a corresponding circumferential groove and rib in the housing opening, thereby permitting relative rotation of the adjustment collar to the housing which serves to set the relative axial position of the depth locator. The adjustment collar and depth locator subassembly may be removed from the housing without disturbing the depth setting by depressing the spring fingers sufficiently to release the hooks from the groove in the housing. The rearward facing ends of the hooks are preferably provided with chamfered cam surfaces so that the depth adjustment subassembly can be readily reinstalled onto the tool by inserting the rearward end of the adjustment collar into the opening in the tool housing until the hooks on the spring fingers snap into the groove in the housing.

15 Claims, 3 Drawing Sheets

DEPTH ADJUSTING SYSTEM FOR A POWER TOOL

BACKGROUND AND SUMMARY

The present invention relates to depth adjusting systems for tools and, in particular, to an adjustable depth locator for power-driven screwdrivers.

Power-driven screwdrivers frequently are equipped with depth locators that are releasably mounted to the nose of the tool and surround the screwdriver bit for adjustably setting the depth to which the head of the screw will be set into the workpiece. In particular, the axial position of the depth locator is typically adjustable relative to the tool bit so as to control the extent to which the screwdriver bit protrudes from the end of the depth locator. Consequently, as the screw is driven into a workpiece, the end of the depth locator will contact the surface of the workpiece thereby unloading the axial pressure on the screwdriver bit which serves to disengage the clutch mechanism in the power-driven screwdriver.

It is desirable for depth adjusting systems to be easily adjusted and also readily removable from the tool housing while maintaining the depth setting to enable the operator to conveniently replace the screwdriver bit. A known depth adjusting system is shown in U.S. Pat. No. 4,647,260 to O'Hara et al., and assigned to the assignee of record of the present invention. The depth adjusting system disclosed in this patent comprises a two-piece molded plastic subassembly that is connected to the forward end of the housing of the power tool. The subassembly comprises an adjustment collar that is mounted to the nose portion coaxial with the tool bit so as to be restrained from axial movement but free to rotate relative to the housing, and a depth locator that is threadably connected to the adjustment collar and restrained from rotating relative to the housing but free to move axially relative to the housing in response to rotation of the adjustment collar. The adjustment collar is provided with an internal annular flange that is engageable via a snap-action with a retaining ring located on the nose portion of the housing. In addition, indexing means in the form of a plurality of circumferential resilient fingers are provided on the adjustment member for engaging detents on the nose portion of the tool and serve to settably maintain the adjustment member in a predetermined angular position relative to the housing. The resulting depth adjusting system disclosed in this patent enables an operator to disconnect the subassembly by unsnapping the adjustment member from the housing without disturbing the previously set depth adjustment.

It is further desirable, however, to provide a depth adjusting system that is more convenient to remove from the nose portion of the housing and that provides a greater mechanical advantage in rotatably adjusting the position of the adjustment member.

The present invention comprises an improvement over the depth adjusting system disclosed in the aforementioned patent providing an improved interface between the adjusting member and the forward end of the housing. In particular, the adjustment member in the present invention is provided with an enlarged cylindrically shaped collar portion having a pair of axially extending, cantilevered spring fingers with hook portions formed on their free ends for releasably engaging an internal circular groove in the housing opening. The cantilevered spring fingers are integrally formed at radially opposed locations on the collar portion of the adjustment member so that the adjustment member can be readily removed from the housing by simultaneously squeezing both spring fingers to disengage the hook portions of the fingers from the groove in the housing. In normal operation, however, the engagement of the hook portions of the resilient fingers in the internal groove in the housing enables the adjustment member to be freely rotated relative to the housing. Preferably, indexing means similar to that described in the aforementioned patent are also provided to maintain the adjustment member in a set angular position relative to the housing. Raised ribs integrally formed on the outer surface of the enlarged collar portion of the adjustment member, together with the greater size of the enlarged collar portion, also enable the operator to more easily adjust the angular position of the adjustment member.

BRIEF DESCRIPTION OF THE DRAWINGS

Additional objects and advantages of the present invention will become apparent from a reading of the following detailed description of the preferred embodiment which makes reference to the drawings of which.

DETAILED DESCRIPTION OF THE PREFERRED EMBODIMENT

Figure 1:
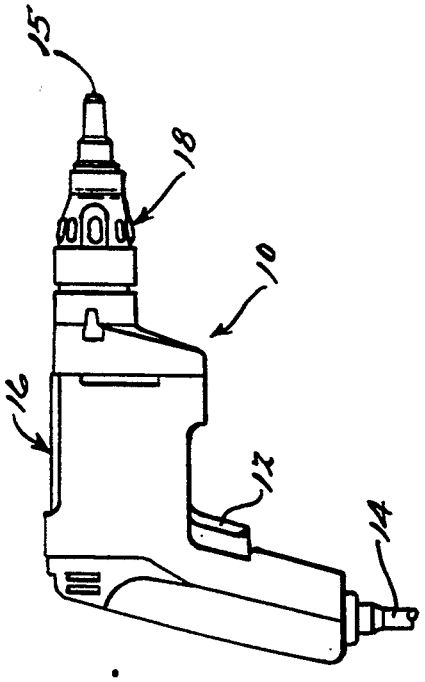
FIG. 1 is a side elevational view of a power screwdriver incorporating the depth adjusting system according to the present invention.

Referring to FIG. 1, a power tool such as a power screwdriver is shown embodying the present invention and is referred to generally as 10. The tool 10 is powered by a motor (not shown) actuated by a trigger switch 12 which controls electrical energy provided to the motor through the power cord 14. The power tool 10 includes a housing 16 to which is connected the depth adjusting system 10 of the present invention. A tool bit 15 having a predetermined axial length is connected to the power tool 10 and extends outwardly from the depth adjusting system 18.

Figure 2:
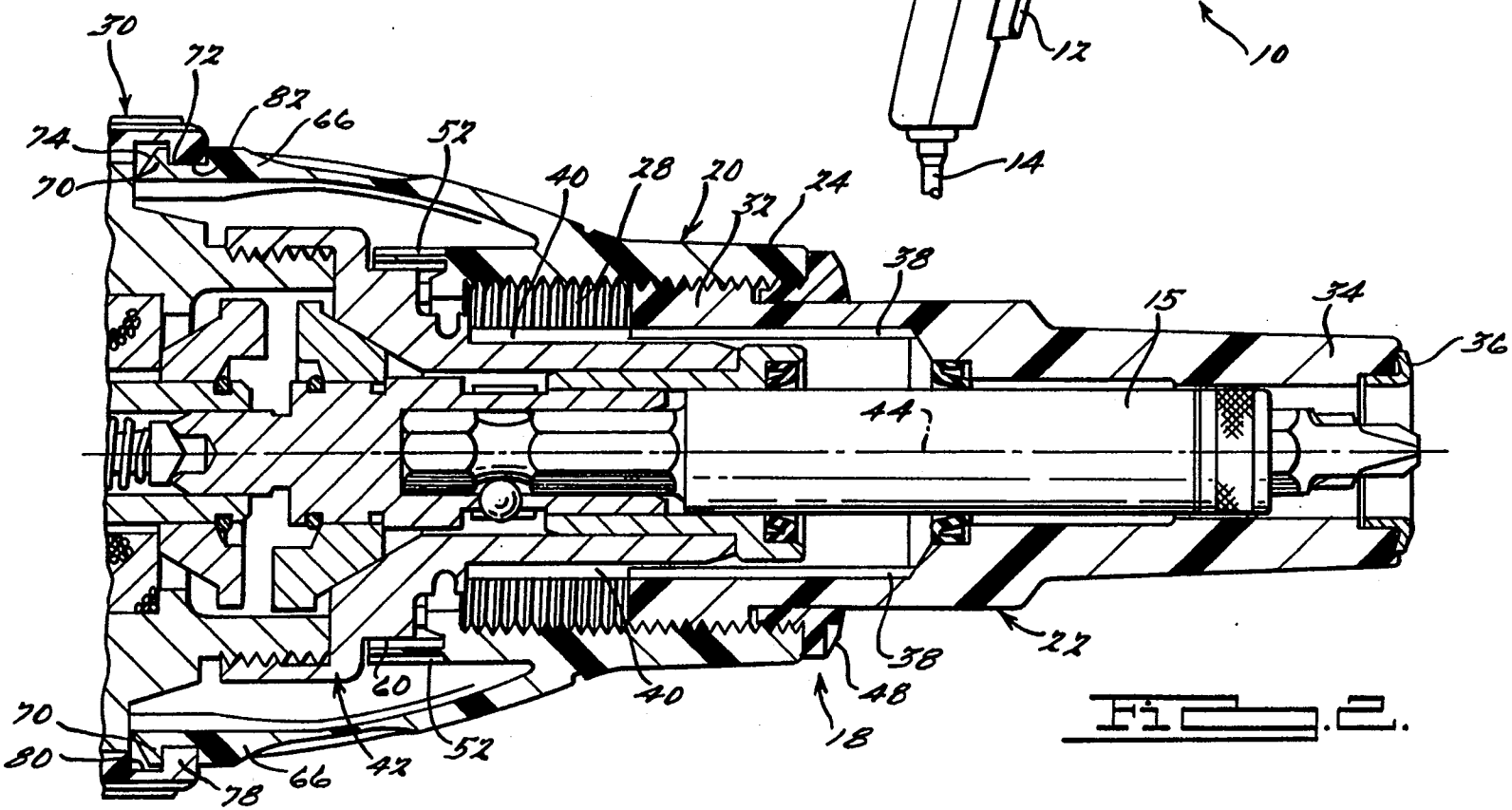
FIG. 2 is a side elevational view partially in cross-section of the depth adjusting system according to the present invention.

With reference to FIG. 2, a cross-sectional view of the depth adjusting system 18 according to the present invention is shown. The depth adjusting system 18 comprises a subassembly consisting primarily of an adjustment collar 20 and a depth locator 22. The adjustment collar 20 preferably comprises a one-piece molded plastic member having a front cylindrical portion 24 and an enlarged rear cylindrical portion 26 that is releasably connected to the forward end of the housing 30 of the tool in a manner to be subsequently described. The front cylindrical portion 24 of the adjustment collar 20 is internally threaded at 28 and is adapted to engage the external threads formed on the rear cylindrical portion 32 of the depth locator 22. The depth locator 22 also preferably comprises a one-piece molded plastic member and includes a forward workpiece engaging portion 34 that is provided with a wear-resistant metal insert 36 at its distal end. The depth locator 22 is additionally provided with a pair of longitudinal keys 38 that are integrally formed internally on the rear cylindrical portion 32 and which are adapted to engage keyways 40 formed in the nose portion 42 of the power tool. The engagement of the keys 38 of the depth locator 22 with the keyways 40 prevents the depth locator from rotating and enables the depth locator 22 to move axially relative to the axis 44 of the tool bit 15 as the adjustment collar 20 is rotated. A sealing element 48 is threaded onto the end of the adjustment collar 20 to inhibit the passage of foreign particles and debris into the interior of the housing 30.

Figure 3:
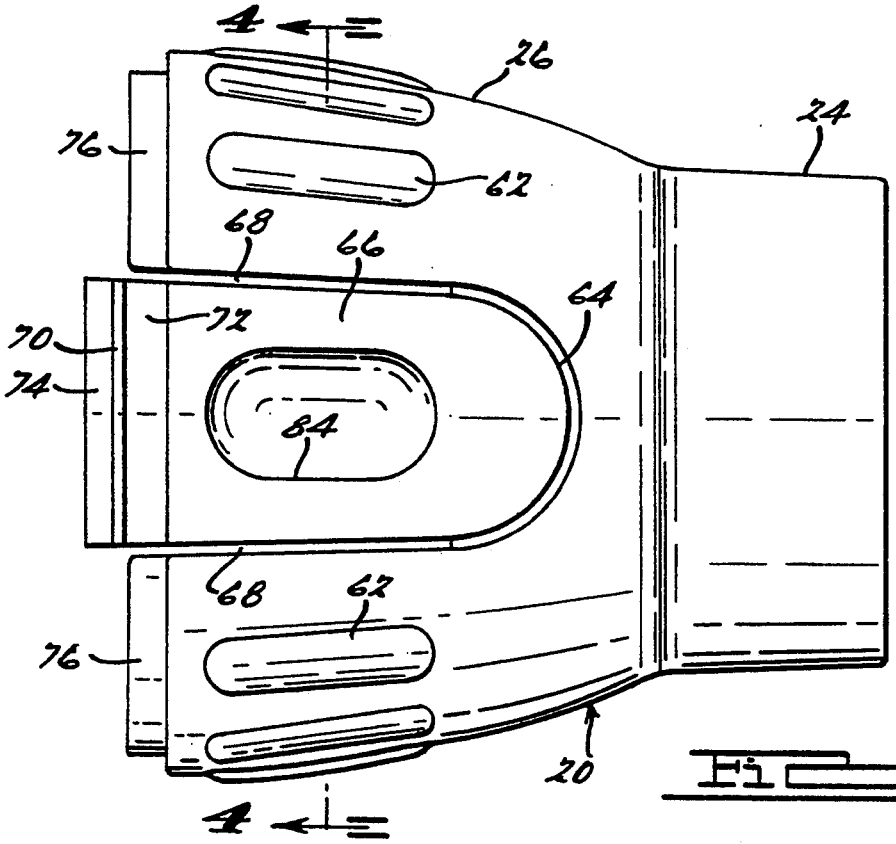
FIG. 3 is a side elevational view of the adjustment member of the depth adjusting system shown in FIG. 2.
Figure 4:
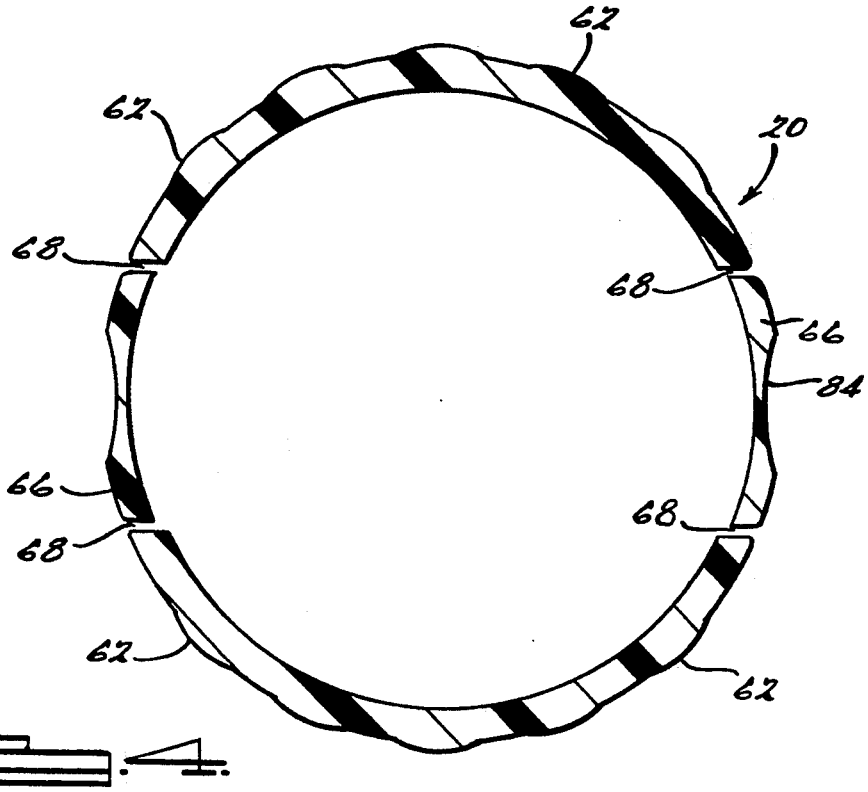
FIG. 4 is a transverse sectional view of the adjustment member taken along line 4—4 in FIG. 3.
Figure 5:
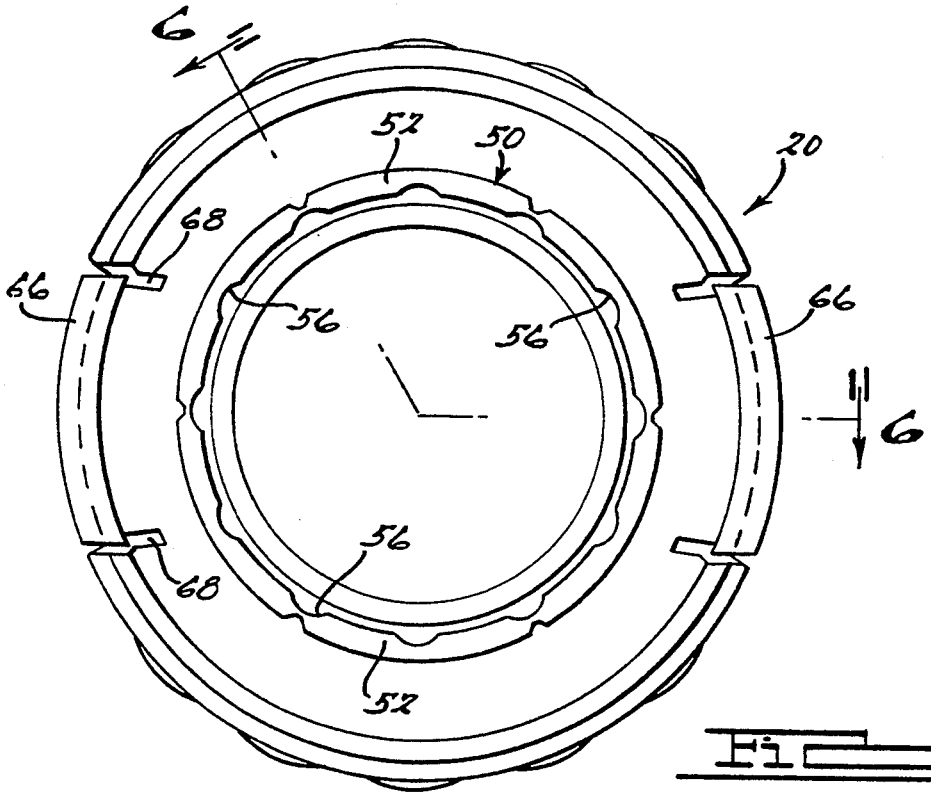
FIG. 5 is a rear elevational view of the adjustment member taken along line 5—5 in FIG. 3.
Figure 6:
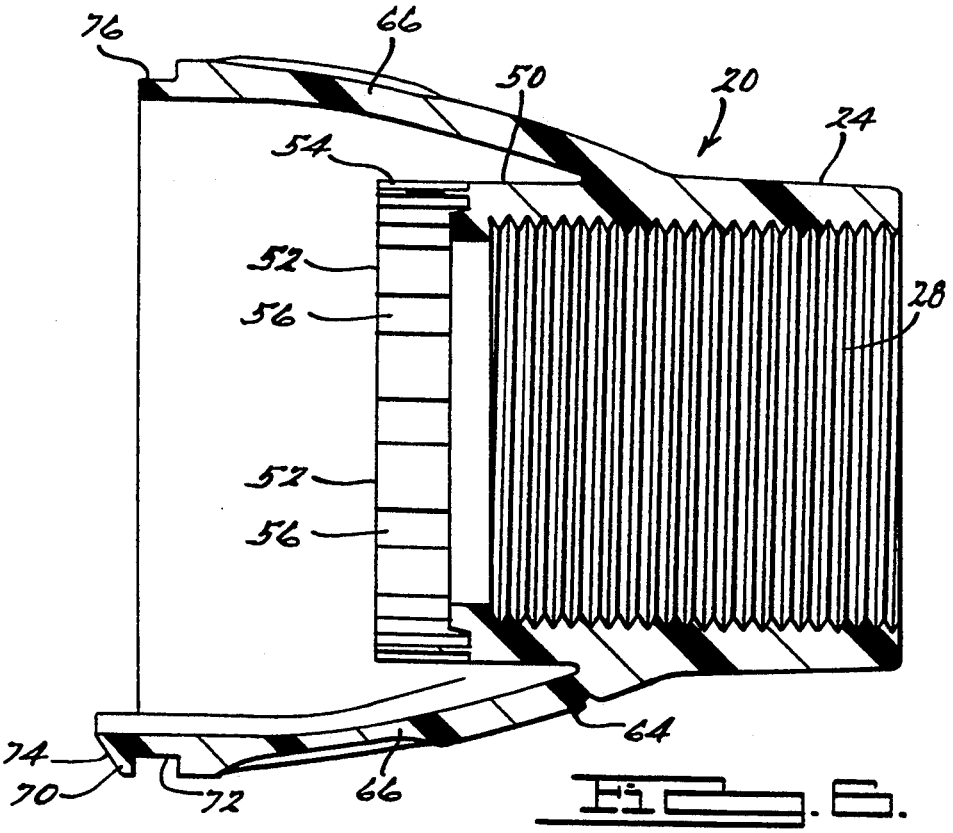
FIG. 6 is an axial cross-sectional view of the adjustment member taken along line 6—6 in FIG. 5.

Turning now to FIGS. 3—6, detailed views of the adjustment collar 20 according to the present invention are shown. As best shown in FIGS. 5 and 6, the adjustment collar 20 includes an internal annular flange 50 having a plurality of resilient indexing fingers 52 extending axially rearwardly of the internal flange. The indexing fingers 52 are provided with notches 54 to enhance their resiliency. At equally radially spaced locations on the internal surface of the indexing finger 52 are formed a plurality of axially extending grooves 56 that are adapted to engage a plurality of bumps (not shown) formed on the external surface of an annular shoulder 60 of the nose portion 42 of the tool (FIG. 2). The inter-engagement of the grooves 56 with the bumps provides incremental rotational adjustment of the adjustment collar 20 and enables the adjustment collar 20 to retain a rotationally set position.

As best shown in FIGS. 3 and 4, the enlarged rear cylindrical portion 26 of the adjustment collar 20 preferably has integrally formed at radially spaced locations around its outer surface a plurality of raised ribs 62 which assist the operator in gripping the adjustment collar 20 when rotationally adjusting its position. In addition, it will be appreciated that the increased diameter of the enlarged rear cylindrical portion 26 of the adjustment collar 20 provides the operator with increased mechanical advantage to overcome the frictional engagement of the resilient indexing fingers 52 with the bumps on the annular shoulder 60 of the nose portion 42 of the tool when making adjustments in the rotational position of the adjustment collar 20.

The enlarged rear cylindrical portion 26 of the adjustment collar 20 is further provided with a pair of axially extending cantilevered spring fingers 66 at diametrically opposed locations on the adjustment collar 20. The spring fingers 66 are integrally joined to the adjustment collar 20 at their base 64 and are defined by a pair of substantially parallel slits 68 formed on either side of each finger 66. With particular reference to FIG. 6, the free end of each finger 66 has formed thereon a hook 70 defined by a circumferential groove 72 formed forwardly of the hook 70 and a chamfered cam surface formed on the rearward facing surface of the hook 70. As best shown in FIGS. 3 and 6, the hook 70 extends rearwardly in the axial direction beyond the rear cylindrical portion 26 of the adjustment collar 20, which terminates in a radially recessed flange 76 that is circumferentially aligned with the grooves 72 formed in the spring fingers 66 adjacent the hooks 70.

Returning now to FIG. 2, the circular opening 82 in the forward end of the housing 30 is provided with a radially inwardly projecting circumferential rib 78 whose minimum inside diameter is slightly larger than the outside diameter of the flange 76 on the rearward end of the adjustment collar 20 and the grooves 72 adjacent the hooks 70 on the spring fingers 66. In addition, a circumferential groove 80 is formed in the housing 30 immediately rearward of the circumferential rib 78. The adjustment collar 20 is thus connected to the housing 30 by inserting the rearward end of the adjustment collar 20 into the opening 82 in the housing 30 so that the cam surfaces 74 on the rearward ends of the hooks 70 engage the circumferential rib 78 in the housing 30. Further axial insertion of the adjustment collar 20 causes the spring fingers 66 to flex radially inwardly until the hook portions 70 snap into the circumferential groove 80 in the housing 30, thereby securing the adjustment collar 20 to the housing 30. When properly installed, the engagement of the hook 70, groove 72, and recessed flange 76 of the adjustment collar 20 with the circumferential groove 80 and rib 78, respectively, in the housing 30 enable the adjustment collar 20 to rotate freely relative to the housing 30 while constraining the adjustment collar 20 against axial movement relative to the housing 30.

To remove the adjustment collar 20 from the housing 30, the free ends of the spring fingers 66 are depressed or squeezed toward each other, thereby releasing the hooks 70 from the groove 80 and enabling the withdrawal of the adjustment collar 20. A depression 84 (FIG. 3) is preferably formed in the outer surface of each spring finger 66 to assist the operator in tactiley locating the appropriate finger positions for applying releasing force to the spring fingers 66.

In operation, therefore, the depth adjusting system is set by rotationally adjusting the position of adjustment collar 20 which causes axial displacement of the depth locator 22 either inwardly or outwardly relative to the screwdriver bit 15 depending upon the direction of rotation of the adjustment collar 20. The resulting axial position of the workpiece engaging portion 36 of the depth locator 22 relative to the end of the screwdriver bit 15 controls the depth to which the head of the fastener is set relative to the surface of the workpiece. When the screwdriver bit 15 needs to be replaced the depth adjusting subassembly is readily removed from the housing 30 by depressing the two opposed spring fingers 66 to release the hooks 70 from the groove 80 in the housing 30. Significantly, it will be appreciated that the selected depth adjustment setting is not disturbed when the subassembly is removed from the housing. To reinstall the subassembly onto the housing 30, the adjustment collar 20 is simply inserted into the opening 82 in the housing 30 until the hooks 70 on the ends of the spring fingers 66 snap back into the circumferential groove 80 in the housing 30.

While the above description constitutes the preferred embodiment of the invention, it will be appreciated that the invention is susceptible to modification, variation, and change without departing from the proper scope or fair meaning of the accompanying claims.

What is claimed is:

1. A depth adjusting system for a power tool having a housing and a circular opening in a forward portion of the housing defining an axis, said depth adjusting system comprising an adjustment collar rotatably coupled to the opening in the housing of the tool and a depth locator threadably connected to said adjustment collar and constrained from rotating relative to the housing so that rotation of said adjustment collar causes axial displacement of said depth locator; the improvement wherein said adjustment collar includes at least one rearwardly extending cantilevered spring finger having a hook member located thereon for releasably engaging a circumferential groove formed proximate to the opening in said housing, such that when said hook member is engaged with said circumferential groove said adjustment collar is rotatable relative to the housing but constrained against axial movement, and further wherein said adjustment collar is removable from said housing by depressing said spring finger radially inwardly to release said hook member from said circumferential groove.

2. The depth adjusting system of claim 1 wherein said adjustment collar includes a pair of diametrically opposed cantilevered spring fingers of substantially identical configuration.

3. The depth adjusting system of claim 2 wherein each of said cantilevered spring fingers is further provided with a groove formed adjacent to said hook member that is adapted to matingly engage a circumferential rib formed adjacent to said circumferential groove in the housing.

4. The depth adjusting system of claim 3 wherein a cam surface is formed on the rearward facing end of each of said hook members that is adapted to engage said circumferential rib in said housing as said adjustment collar is being installed in the opening in the housing to cause said spring fingers to deflect radially inwardly until said hook members snap into said circumferential groove in the housing.

5. The depth adjusting system of claim 2 wherein said adjustment collar comprises a front cylindrical portion and an enlarged rear cylindrical portion, said cantilevered spring fingers being integrally formed with said enlarged rear cylindrical portion.

6. The depth adjusting system of claim 5 wherein said enlarged rear cylindrical portion further includes gripping means formed thereon for assisting the operator of the tool to rotatably adjust the position of said adjustment collar.

7. A power screwdriver having a motor mounted within a housing for rotatably driving a screwdriver bit defining an axis and having a predetermined axial length, said housing having a circular opening formed in a forward portion thereof for releasably receiving a depth adjusting system for adjustably controlling the depth to which a threaded fastener is installed into a workpiece, said depth adjusting system comprising an adjustment collar rotatably coupled to the opening in said housing and a substantially cylindrical depth locator surrounding said bit and threadably connected to said adjustment collar and constrained from rotating relative to said housing so that rotation of said adjustment collar causes axial displacement of said depth locator relative to said bit; the improvement wherein said adjustment collar includes at least one rearwardly extending cantilevered spring finger having a hook member located thereon for releasably engaging a circumferential groove formed proximate to the opening in said housing, such that when said hook member is engaged with said circumferential groove said adjustment collar is rotatable relative to the housing but constrained against axial movement, and further wherein said adjustment collar is removable from said housing by depressing said spring finger radially inwardly to release said hook member from said circumferential groove.

8. The power screwdriver of claim 1 wherein said adjustment collar includes a pair of diametrically opposed cantilevered spring fingers of substantially identical configuration.

9. The power screwdriver of claim 8 wherein each of said cantilevered spring fingers is further provided with a groove formed adjacent to said hook member that is adapted to matingly engage a circumferential rib formed adjacent to said circumferential groove in the housing.

10. The power screwdriver of claim 9 wherein a cam surface is formed on the rearward facing end of each of said hook members that is adapted to engage said circumferential rib in said housing as said adjustment collar is being installed in the opening in the housing to cause said spring fingers to deflect radially inwardly until said hook members snap into said circumferential groove in the housing.

11. The power screwdriver of claim 8 wherein said adjustment collar comprises a front cylindrical portion and an enlarged rear cylindrical portion, said cantilevered spring fingers being integrally formed with said enlarged rear cylindrical portion.

12. The power screwdriver of claim 11 wherein said enlarged rear cylindrical portion further includes gripping means formed thereon for assisting the operator of the tool to rotatably adjust the position of said adjustment collar.

13. A depth adjusting system for a power screwdriver having a housing and a circular opening in a forward portion of the housing defining an axis, said depth adjusting system comprising an adjustment collar rotatably coupled to the opening in the housing of the screwdriver and a depth locator threadably connected to said adjustment collar and constrained from rotating relative to the housing so that rotation of said adjustment collar causes axial displacement of said depth locator; the improvement wherein said adjustment collar comprises a one-piece molded plastic member having a forward portion and an enlarged substantially cylindrical rearward portion including a pair of diametrically opposed cantilevered spring fingers axially extending rearwardly of said rearward portion and having formed adjacent their free ends a hook and groove adapted for releasably engaging a circumferential groove and circumferential rib, respectively, formed proximate to the opening in said housing, thereby enabling said adjustment collar to rotate relative to said housing while constraining said adjustment collar against axial movement, said adjustment collar being removable from said housing by depressing said spring fingers radially inwardly to release said hooks from said circumferential groove.

14. The depth adjusting system of claim 13 wherein said enlarged rearward portion of said adjustment collar further includes a radially recessed flange that is circumferentially aligned with said grooves in said spring fingers and also adapted for engagement with said circumferential rib in said housing.

15. The depth adjusting system of claim 14 wherein the hook on each spring finger is provided with a cam surface on its rearward facing end that is adapted to engage said circumferential rib in said housing when said adjustment collar is being installed onto said housing to thereby cause said spring fingers to deflect radially inwardly until said hooks snap into said circumferential groove in said housing.

* * * * *